US005868073A

United States Patent [19]

Ebina

[11] Patent Number: 5,868,073

[45] Date of Patent: Feb. 9, 1999

[54] CLEANING APPARATUS FOR WEB OFFSET PRINTING PRESS

[75] Inventor: Toshihiko Ebina, Ibaragi, Japan

[73] Assignee: Komori Corporation, Japan

[21] Appl. No.: 57,326

[22] Filed: Apr. 8, 1998

[30] Foreign Application Priority Data

Apr. 11, 1997 [JP] Japan ..... 9-093719

[51] Int. Cl.[6] ..... B41F 35/06

[52] U.S. Cl. ..... 101/425; 101/423

[58] Field of Search ..... 101/425, 423, 101/424; 15/256.51, 256.5

[56] References Cited

U.S. PATENT DOCUMENTS

| | | | |
|---|---|---|---|
| 3,128,207 | 4/1964 | Schmitt | 15/256.51 |
| 4,568,174 | 2/1986 | Stange | 15/256.51 |
| 5,168,812 | 12/1992 | Sugiyama | 101/425 |
| 5,425,309 | 6/1995 | Saito et al. | 101/423 |

FOREIGN PATENT DOCUMENTS 6-262757 9/1994 Japan .

*Primary Examiner*—Edgar Burr
*Assistant Examiner*—Anthony H. Nguyen
*Attorney, Agent, or Firm*—Blakely Sokoloff Taylor & Zafman

[57] ABSTRACT

A cleaning apparatus for a rotary printing press includes a cleaning blade, a cleaning cloth, and a cleaning unit and air cylinders, or an air cylinder, a guide shift mechanism, and a cleaning cloth travel mechanism. The cleaning blade has a distal end portion which abuts against the circumferential surface of an oscillating roller during a cleaning operation to scrape a waste ink, and a rear surface continuous to the distal end portion to guide the scraped waste ink downward. The cleaning cloth travels during the cleaning operation done by the cleaning blade to collect the waste ink scraped by the cleaning blade. The cleaning unit and air cylinders, or the air cylinder, the guide shift mechanism, and the cleaning cloth travel mechanism bring the cleaning cloth into contact with the rear surface of the cleaning blade, when the distal end portion of the cleaning blade is in contact with the circumferential surface of the oscillating roller, to collect the waste ink on the cleaning blade.

13 Claims, 8 Drawing Sheets

CLEANING APPARATUS FOR WEB OFFSET PRINTING PRESS

BACKGROUND OF THE INVENTION

The present invention relates to a cleaning apparatus for cleaning the ink rollers of a rotary printing press.

In the rotary printing press, when the printing operation is ended or when the color of an ink in the ink fountain is to be changed, the ink in the ink fountain is discharged and an ink roller cleaning operation is performed to clean off the ink attaching to the circumferential surfaces of the respective rollers of an ink ductor roller group so as not to affect the next printing operation.

In this cleaning apparatus, a cleaning solution is sprayed to the upstream ink roller of the ink roller group, and the cleaning solution and the waste ink transferred to the downstream ink roller are scraped with a cleaning blade abutting against the circumferential surfaces of the ink rollers to drop into a cleaning solution tank. With this arrangement, every time the circumferential surfaces of the ink rollers are cleaned, the ink attaching to the distal end of the cleaning blade and to the cleaning solution tank must be cleaned, leading to a burden on the person in charge of the cleaning operation.

As a cleaning apparatus which reduces the burden on the person in charge of the cleaning operation, one in which the waste ink scraped with the cleaning blade is collected with a cleaning cloth is proposed. Japanese Patent Laid-Open No. 6-262757 (Reference 1) discloses a cleaning device in which the waste ink on the circumferential surface of the ink roller is wiped off with a cleaning cloth urged against the circumferential surface of the ink roller through a pad, and the cleaning cloth is also urged against the cleaning blade urged against the circumferential surface of the ink roller, so that the waste ink scraped with the cleaning blade is collected by the cleaning cloth.

U.S. Pat. No. 5,168,812 (Reference 2) discloses a cleaning apparatus in which the waste ink on the circumferential surface of the ink roller is scraped with a cleaning blade, and the cleaning blade can come into contact with and separate from the circumferential surface of the ink roller. When it is separated, the cleaning blade is abutted against a cleaning cloth that awaits on the rear surface side of the cleaning blade, thereby collecting the waste ink.

With the device of Reference 1 described above, since the cleaning cloth is strongly urged against the circumferential surface of the ink roller, the cleaning cloth tends to be torn apart by the ink roller rotating at a high speed during cleaning. In order to prevent this, an expensive special cleaning cloth having high durability must be used. Because of the viscosity of the waste ink wiped by the cleaning cloth, the cleaning cloth is pulled and caught by the circumferential surface of the ink roller, causing a cleaning trouble.

With the apparatus of Reference 2, since the cleaning blade is intermittently separated from the circumferential surface of the ink roller during cleaning, the time period while the cleaning blade is separate results in a time loss, additionally prolonging the cleaning time.

SUMMARY OF THE INVENTION

It is an object of the present invention to provide a cleaning apparatus for a rotary printing press, in which a cleaning time is reduced.

It is another object of the present invention to provide a cleaning apparatus for a web offset printing press, in which occurrence of a cleaning trouble is prevented.

In order to achieve the above objects, according to the present invention, there is provided a cleaning apparatus for a rotary printing press, comprising a cleaning blade having a distal end portion which abuts against a circumferential surface of an ink roller during a cleaning operation to scrape a waste ink, and a guide surface continuous to the distal end portion to guide the scraped waste ink downward, a cleaning web which travels during the cleaning operation done by the cleaning blade to collect the waste ink scraped by the cleaning blade, and an ink collection mechanism for bringing the cleaning web into contact with the guide surface of the cleaning blade, when the distal end portion of the cleaning blade is in contact with the circumferential surface of the ink roller, to collect the waste ink on the cleaning blade.

DESCRIPTION OF THE PREFERRED EMBODIMENTS

The present invention will be described in detail with reference to the accompanying drawings.

Figure 1:
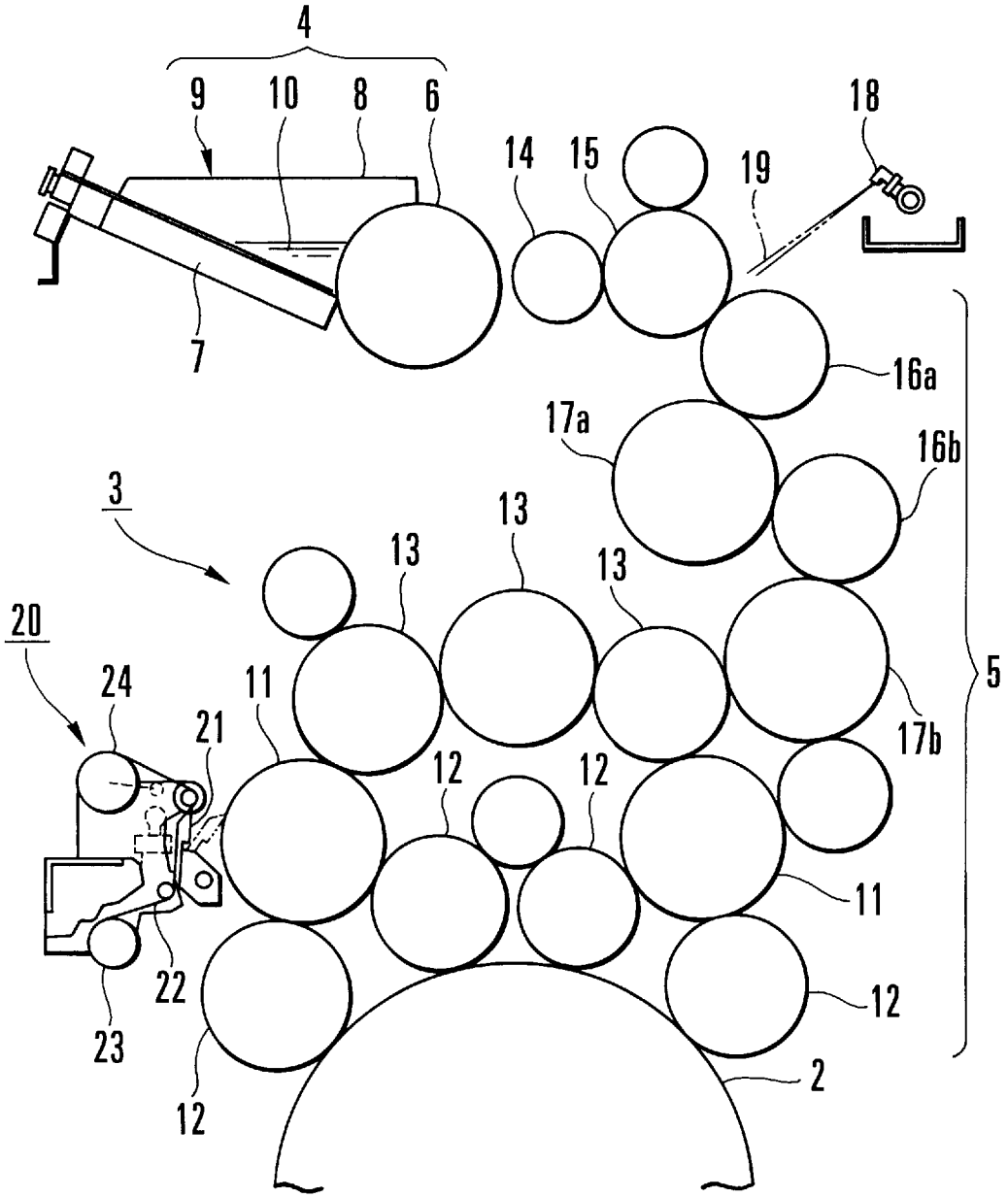
FIG. 1 is a side view of an inking device to which a cleaning apparatus for a rotary printing press according to the present invention is applied.

FIG. 1 shows an inking device to which a cleaning apparatus for a rotary printing press according to the present invention is applied. Referring to FIG. 1, a plate is mounted on the circumferential surface of a plate cylinder 2. The two ends of the shaft of the plate cylinder 2 are rotatably supported between the frames (not shown) of the printing press through bearings. An inking device 3 constituted by an ink supply unit 4 and an ink roller group 5 is arranged between inker frames (to be described later).

The ink supply unit 4 has an ink fountain roller 6, an ink blade 7, a pair of right and left ink dams 8, and an ink fountain 9. The distal end of the ink blade 7 comes close to the circumferential surface of the ink fountain roller 6. The ink dams 8 sandwich the ink fountain roller 6 and ink blade 7. The ink fountain 9 is constituted by the circumferential surface of the ink fountain roller 6, the ink blade 7, and the ink dams 8 to store an ink 10.

A pair of ink form rollers 12 supported by two oscillating rollers 11 through arms (not shown) are detachably in contact with the circumferential surface of the plate cylinder 2. Above the oscillating rollers 11, three ink distribution rollers 13 are arranged in series between the oscillating rollers 11 such that their circumferential surfaces are in contact with each other. An ink feed roller 14 reciprocally moves between the ink fountain roller 6 and an ink distribution roller 15 while alternately coming into contact with them. An ink distribution roller 16*a* is in contact with the ink distribution roller 15.

An ink oscillating roller 17*a,* an ink distribution roller 16*b,* and an ink oscillating roller 17*b* are arranged between the ink distribution roller 16*a* and the ink distribution roller 13 on one end side in the ink feed order. The oscillating rollers 11, the ink form rollers 12, the ink distribution rollers 13, the ink feed roller 14, the ink distribution rollers 15, 16*a,* and 16*b,* and the ink oscillating rollers 17*a* and 17*b* constitute the ink roller group 5. Above the ink roller group 5, a plurality of cleaning nozzles 18 that supply a cleaning solution 19 to the circumferential surfaces of the ink distribution rollers 15 and 16*a* during cleaning are arranged in the axial direction of the rollers.

Figure 2:
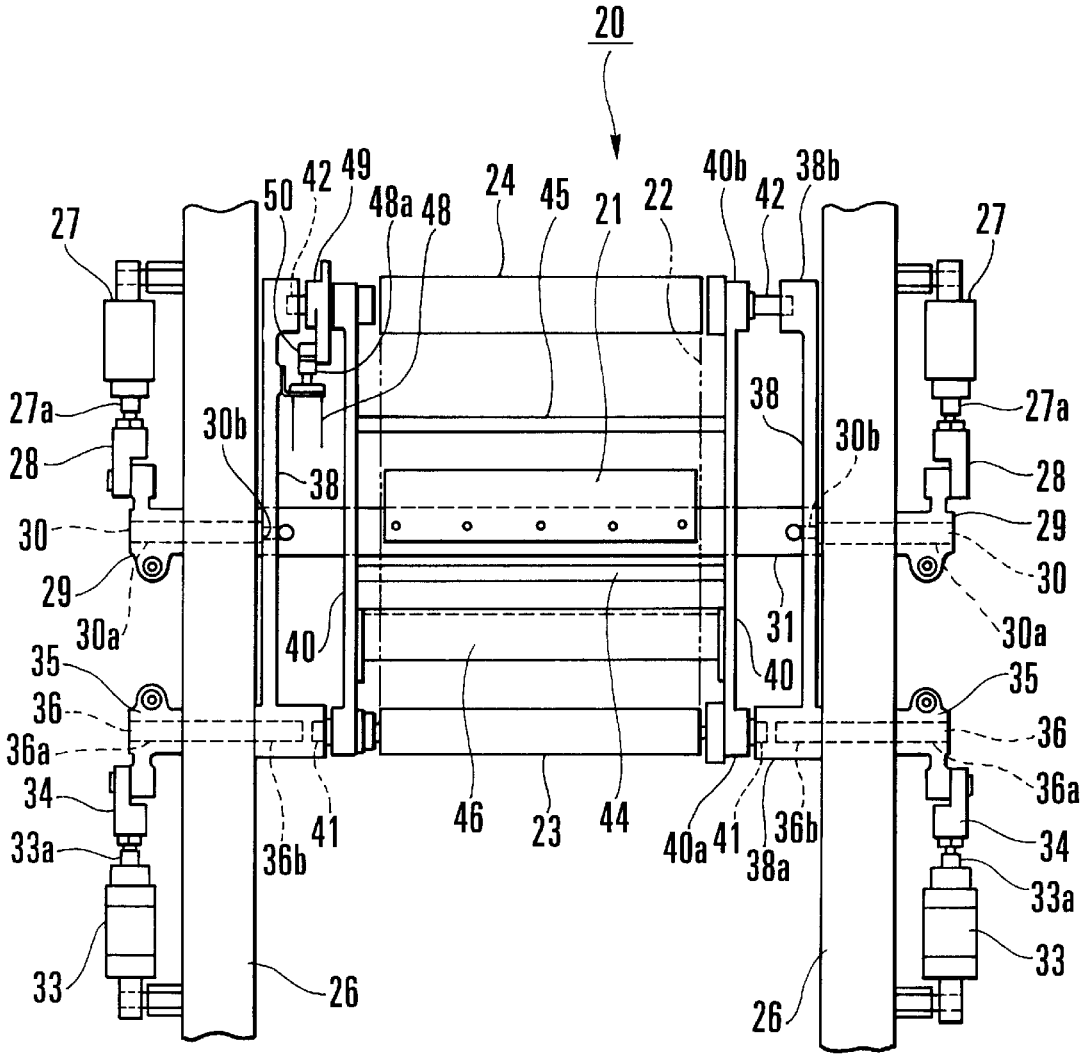
FIG. 2 is a developed front view of a cleaning unit constituting a cleaning apparatus according to the first embodiment of the present invention.
Figure 3:
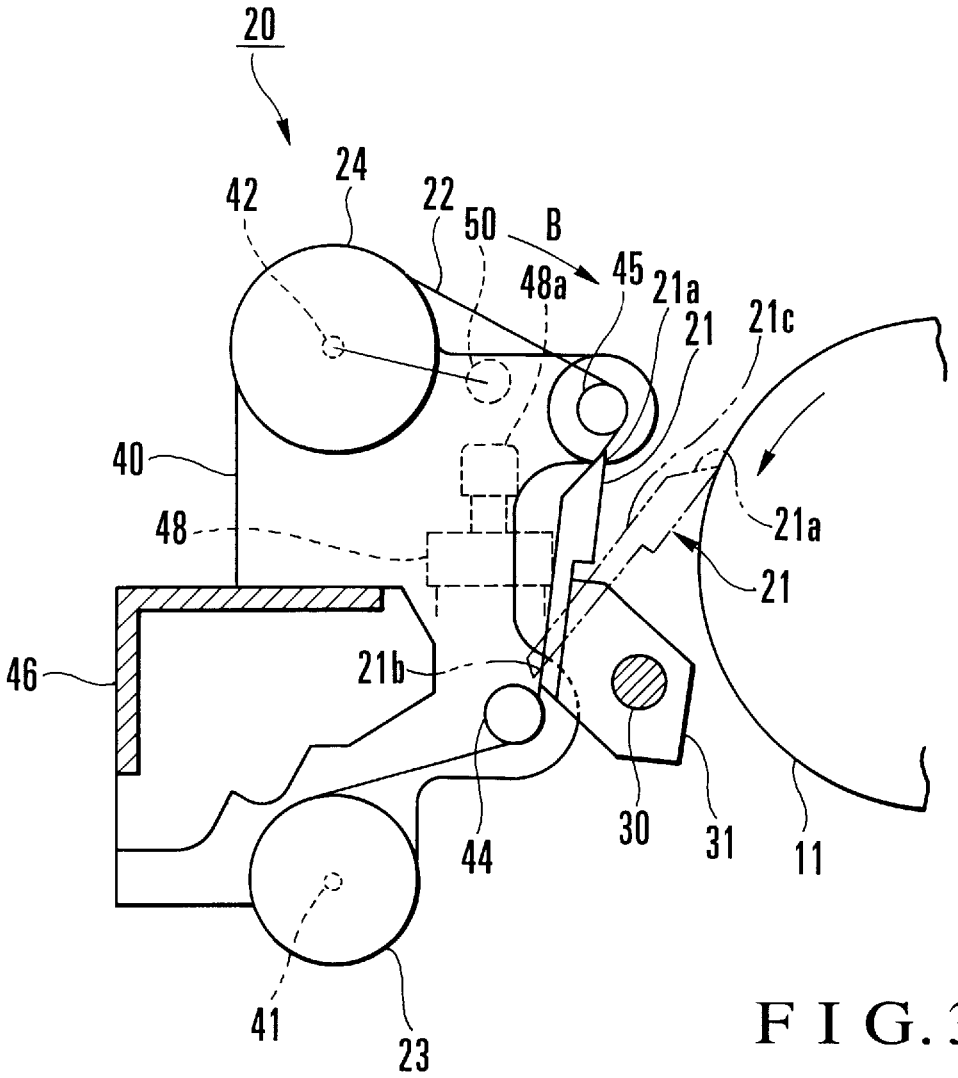
FIG. 3 is a side view of the cleaning unit shown in FIG. 2.

FIG. 2 shows a cleaning apparatus according to the first embodiment of the present invention, and FIG. 3 shows a cleaning unit shown in FIG. 2.

As shown in FIG. 3, a cleaning unit 20 is arranged near one oscillating roller 11. The cleaning unit 20 has a cleaning blade 21, a cleaning cloth 22, a supply roll 23, and a take-up roll 24. The cleaning blade 21 is formed slightly longer than the cylinder length of the oscillating roller 11. The cleaning cloth 22 has a width slightly larger than the entire length of the cleaning blade 21 and wipes off the waste ink scraped by the cleaning blade 21. The supply roll 23 supplies the cleaning cloth 22. The take-up roll 24 takes up the cleaning cloth 22.

Referring to FIG. 2, a pair of air cylinders 27 for attaching/detaching the ink blade are respectively pivotally mounted on the outer sides of a pair of right and left inker frames 26. A rod 27*a* of each air cylinder 27 is connected to one end of a corresponding knuckle joint 28. A lever 29 is pivotally mounted on the other end of each knuckle joint 28. The levers 29 are fixed to projecting end portions 30*a* projecting outward from a shaft 30 pivotally supported by the inker frames 26. An ink blade fixing bar 31 extending between the inker frames 26 is fixed to projecting end portions 30*b* of the shaft 30 that project inward from the inker frames 26. The cleaning blade 21 is fixed to the ink blade fixing bar 31.

While the rods 27*a* of the air cylinders 27 are retracted, a distal end portion 21*a* of the cleaning blade 21 is separate from the circumferential surface of the corresponding oscillating roller 11 (indicated by a solid line in FIG. 3). In this case, the distal end portion 21*a* of the cleaning blade 21 refers to only a sharp-cornered portion having a triangular section on the distal end of the cleaning blade 21. When the air cylinders 27 are actuated and the rods 27*a* move forward, the levers 29 are pivoted through the knuckle joints 28. This pivotal motion is transmitted to the ink blade fixing bar 31 through the shaft 30. Upon pivotal motion of the ink blade fixing bar 31, the distal end portion 21*a* of the cleaning blade 21 abuts against the circumferential surface of the oscillating roller 11 (indicated by an alternate long and two short dashed line in FIG. 3).

A pair of unit oscillating air cylinders 33 are pivotally mounted on the pair of right and left inker frames 26, respectively. A rod 33*a* of each air cylinder 33 is connected to one end of a corresponding knuckle joint 34. A lever 35 is pivotally mounted on the other end of each knuckle joint 34. The levers 35 are fixed to projecting end portions 36*a* projecting outward from shafts 36 pivotally supported by the inker frames 26. Lower end portions 38*a* of unit holders 38 vertically extending along the inner side surfaces of the inker frames 26 are fixed to projecting end portions 36*b* of the shafts 36 that project inward from the inker frames 26.

A pair of unit frames 40 are connected to each other through a stay 46 to oppose each other, and pins 42 and 41 vertically extend from the upper and lower end portions, respectively, of the unit frames 40. The unit frames 40 are supported by the unit holders 38 as their pins 42 and 41 are pivotally supported by upper end portions 38*b* and the lower end portions 38*a*, respectively, of the unit holders 38. The supply roll 23 and take-up roll 24 are pivotally supported between the unit frames 40 to be coaxial with the pins 41 and 42, respectively. Rod-like cloth guides 44 and 45 with which the cleaning cloth 22 kept taut between the supply roll 23 and take-up roll 24 comes into contact are pivotally supported between the unit frames 40.

In the cleaning unit 20 having the above arrangement, while the distal end portion 21*a* of the cleaning blade 21 is separate from the circumferential surface of the oscillating roller 11, as shown in FIG. 3, when the rods 33*a* of the air cylinders 33 are retracted, the cleaning cloth 22 kept taut between the cloth guides 44 and 45 comes into contact with a rear surface (a surface opposite to a surface which is in contact with the oscillating roller 11) 21*c* and the inclined surface of the distal end portion 21*a* of the cleaning blade 21.

While the rods 33*a* of the air cylinders 33 are retracted, when the rods 27*a* of the air cylinders 27 move forward, the distal end portion 21*a* of the cleaning blade 21 pivots in the direction of an arrow B about the shaft 30 as the center to abut against the circumferential surface of the oscillating roller 11. At this time, the cleaning cloth 22 kept taut between the cloth guides 44 and 45 comes into contact with a proximal end portion 21*b* of the cleaning blade 21.

While the distal end portion 21*a* of the cleaning blade 21 is in contact with the circumferential surface of the oscillating roller 11, when the air cylinders 33 are actuated and the rods 33*a* move forward, the levers 35 are pivoted through the knuckle joints 34. The pivotal motion of the levers 35 is transmitted to the unit holders 38 through the shafts 36, and the upper end portions 38*b* of the unit holders 38 pivot about the lower end portions 38*a* as the pivot centers. Upon pivotal motion of the unit holders 38, the pins 42 at the upper end portions of the unit frames 40 pivot in the direction of the arrow B about the pins 41 at the lower end portions as the pivot centers, and the cleaning cloth 22 kept taut between the cloth guides 44 and 45 comes into contact with the entire rear surface 21*c* of the cleaning blade 21.

Referring to FIG. 2, a cloth take-up air cylinder 48 has a rod 48*a* fixed to one unit holder 38, and the rod 48*a* opposes a pin 50 vertically extending from a lever 49 connected to one-end side shaft of the take-up roll 24 through a one-way clutch. When the air cylinder 48 is actuated and the rod 48*a* moves forward, the rod 48*a* abuts against the pin 50 and the lever 49 is pivoted through a predetermined angle. Upon pivotal motion of the lever 49, the take-up roll 24 is pivoted through the one-way clutch, thereby taking up the cleaning cloth 22 by a predetermined amount. Therefore, the cleaning cloth 22 travels intermittently every predetermined unit amount during cleaning.

The cleaning operation of the cleaning apparatus for the rotary printing press having the above arrangement will be described with reference to FIGS. 4A to 4C.

When an ink cleaning button (not shown) is operated, the reciprocal motion of the ink feed roller 14 is stopped, and the ink feed roller 14 is set in contact with the ink distribution roller 15, as shown in FIG. 1. At this time, as shown in FIG. 4A, the cleaning cloth 22 comes into contact with the rear surface 21*c* of the cleaning blade 21 and the rear-side inclined surface of the distal end portion 21*a*.

Figure 4A:
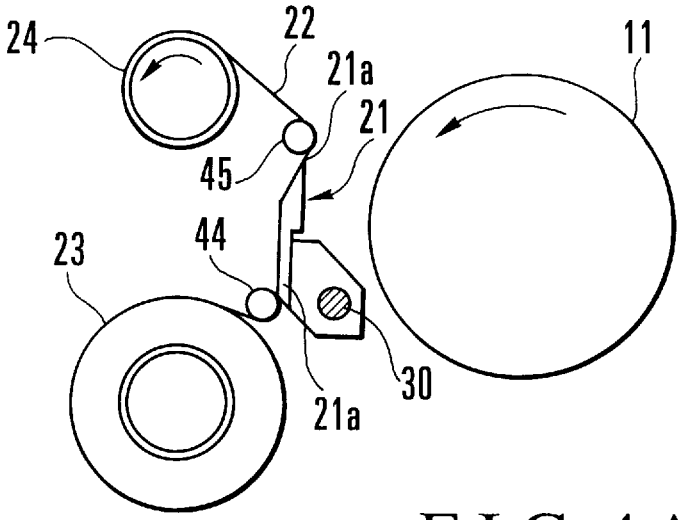
FIGS. 4A to 4C are views for explaining the cleaning operation of the first embodiment of the present invention.
Figure 4B:
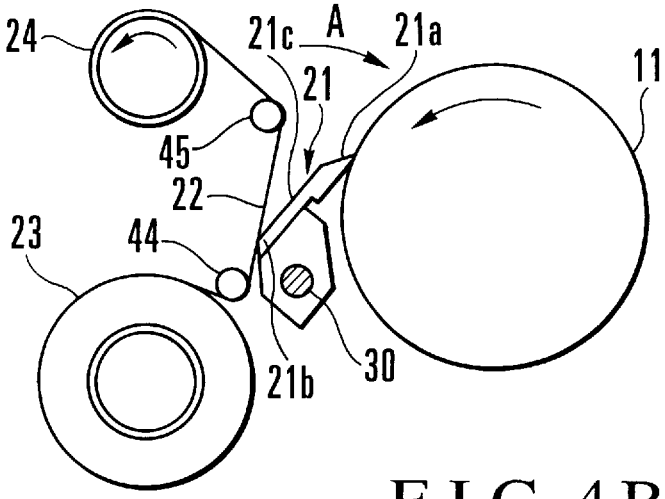

When the air cylinders 27 are actuated and the rods 27*a* move forward, the distal end portion 21*a* of the cleaning blade 21 which has been separate from the oscillating roller 11 is shifted to a state wherein it abuts against the circumferential surface of the oscillating roller 11, as shown in FIG. 4B. At this time, the cleaning cloth 22 kept taut between the cloth guides 44 and 45 separates from the rear surface 21*c* of the cleaning blade 21 and comes into contact with only the proximal end portion 21*b* of the cleaning blade 21.

In this state, the cleaning solution 19 is supplied from the cleaning nozzles 18 to a portion between the ink distribution rollers 15 and 16*a*. The supplied cleaning solution 19 is transferred to the oscillating roller 11 while cleaning the ink attaching to the circumferential surfaces of the rollers 13, ink feed roller 14, ink distribution rollers 15, 16*a*, and 16*b*, and ink oscillating rollers 17*a* and 17*b* of the ink roller group 5, and is scraped as the waste ink with the distal end portion 21*a* of the cleaning blade 21. The waste ink scraped by the cleaning blade 21 flows downward as it is guided along the inclined rear surface 21*c* of the cleaning blade 21 continuous to the distal end portion 21*a*, and is wiped off with the cleaning cloth 22 at the proximal end portion 21*b*.

In this case, since a gap is formed by the rear surface 21*c* and the inclined surface of the distal end portion 21*a* of the cleaning blade 21 and the cleaning cloth 22, the waste ink scraped by the cleaning blade 21 does not overflow from the cleaning blade 21. In this manner, the waste ink is wiped off with the cleaning cloth 22 at the proximal end portion 21*b* of the cleaning blade 21. The waste ink is uniformly wiped off with the cleaning cloth 22 which is intermittently fed, so that the wipe amount wiped by the cleaning cloth 22 does not decrease.

During cleaning, the air cylinder 48 is actuated at a predetermined time period. Hence, the rod 48*a* moves forward to intermittently take up the cleaning cloth 22 with the take-up roll 24 only by a predetermined amount, and a new portion of the cleaning cloth 22 sequentially comes into contact with the proximal end portion 21*b* of the cleaning blade 21.

With the elapse of a predetermined period of time after the start of roller cleaning, the air cylinders 33 are actuated and the rods 33*a* move forward. As shown in FIG. 4C, the take-up roll 24 and the cloth guide 45 are pivoted in the direction of an arrow B about the supply roll 23 as the pivot center, and the cleaning cloth 22 kept taut between the cloth guides 44 and 45 comes into contact with the entire rear surface 21*c* of the cleaning blade 21. In this state, when the air cylinder 48 is actuated, a new portion of the cleaning cloth 22 is fed from the supply roll 23 to the rear surface 21*c* of the cleaning blade 21, to wipe off the ink deposited on the rear surface 21*c* of the cleaning blade 21. At this time, although the cleaning cloth 22 does not come into contact with the inclined surface of the distal end portion 21*a* of the cleaning blade 21, the waste ink is absorbed and collected by the cleaning cloth 22 from the lower end of the inclined surface of the distal end portion 21*a*.

In this manner, since the rear surface 21*c* of the cleaning blade 21 is cleaned and the waste ink on the inclined surface of the distal end portion 21*a* is absorbed after roller cleaning, a decrease in cleaning capacity can be prevented without decreasing the ink scrape amount.

The operation of bringing the cleaning cloth 22 into contact with the entire surface of the rear surface 21*c* of the cleaning blade 21 and separating it therefrom, and the intermittent feed operation of the cleaning cloth 22, described above, are repeatedly performed a predetermined number of times during the cleaning operation in which the distal end portion 21*a* of the cleaning blade 21 abuts against the circumferential surface of the oscillating roller 11 to scrape the waste ink.

When roller cleaning is ended, spraying of the cleaning solution 19 from the cleaning nozzles 18 is stopped, and the air cylinders 33 are actuated. The rods 33*a* are retracted accordingly, and the cleaning cloth 22 is separated from the rear surface 21*c* of the cleaning blade 21, as shown in FIG. 4B. Subsequently, the air cylinders 27 are actuated and the rods 27*a* are retracted, so that the cleaning blade 21 is separated from the circumferential surface of the oscillating roller 11, as shown in FIG. 4A.

At this time, the air cylinder 48 is actuated and the rod 48*a* moves forward, so that the cleaning cloth 22 comes into contact with the rear surface 21*c* and the inclined surface of the distal end portion 21*a* of the cleaning blade 21. Hence, the ink attaching to the inclined surface of the distal end portion 21*a* of the cleaning blade 21 is wiped off with the new portion of the cleaning cloth 22. Since the inclined surface of the distal end portion 21*a* of the cleaning blade 21 is cleaned by the cleaning cloth 22 when the cleaning operation is ended, no cleaning trouble occurs during the subsequent cleaning operation.

Figure 4C:
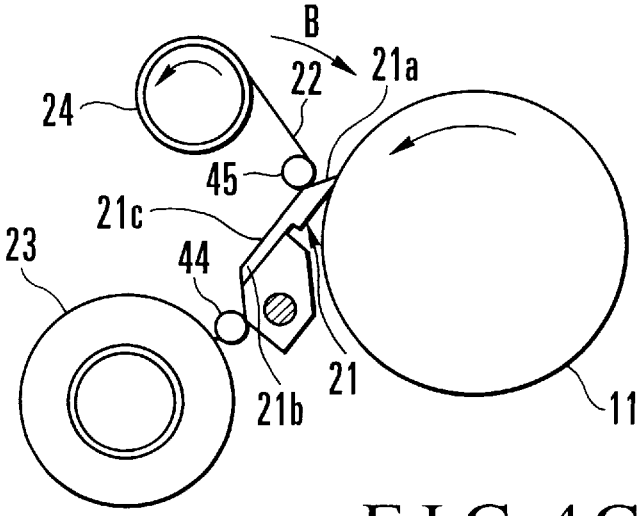

When shifting from the state of FIG. 4A to the state of FIG. 4C, this shift may be made by momentarily passing through the state of FIG. 4B. Alternatively, the state of FIG. 4A may be directly shifted to the state of FIG. 4C without passing through the state of FIG. 4B. In such a case, the operation of cleaning the circumferential surface of the oscillating roller 11 is performed in the state of FIG. 4C.

According to this embodiment, sine the state wherein the cleaning blade 21 abuts against the oscillating roller 11 is held during cleaning, the cleaning time is reduced as compared to a conventional case wherein the cleaning blade 21 intermittently separates from the oscillating roller 11. Since the cleaning cloth 22 does not come into contact with the oscillating roller 11, the cleaning cloth 22 will not be caught by the oscillating roller 11, so that a cleaning trouble is prevented. Since the cleaning cloth 22 will not be torn apart by the oscillating roller 11, no expensive special cleaning cloth having high durability need be employed, and a generally used inexpensive cleaning cloth can be employed.

Figure 5:
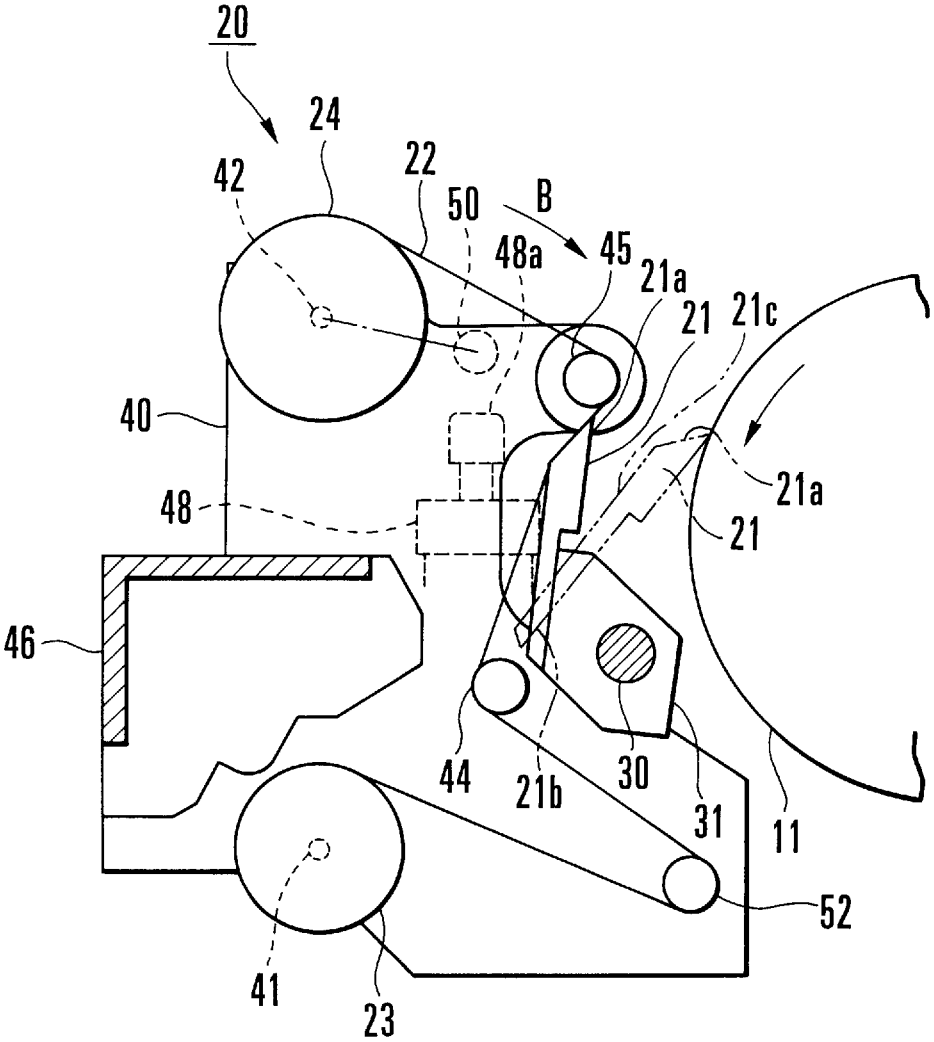
FIG. 5 is a side view of a cleaning unit constituting a cleaning apparatus according to the second embodiment of the present invention.

FIG. 5 shows the cleaning unit of a cleaning apparatus according to the second embodiment of the present invention. In FIG. 5, portions that are identical to those of the first embodiment are denoted by the same reference numerals as in the first embodiment, and a detailed description thereof will be omitted.

As shown in FIG. 5, a rod-like cloth guide 52 is arranged, along a travel path of a cleaning cloth 22 between a lower cloth guide 44 and a supply roll 23, nearer the oscillating roller 11 than the cloth guide 44. The cloth guide 52 is pivotally supported between unit frames 40.

In this arrangement, the cleaning cloth 22 supplied from the supply roll 23 is wound on the cloth guide 52 and is then kept taut between the cloth guide 44 and a cloth guide 45. For this reason, the cleaning cloth 22 wound on the cloth guide 52 is taken up by the cloth guide 44 to be wound on it on a side opposing the supply roll 23. In other words, while it is separate from a proximal end portion 21*b* and a rear surface 21*c* of a cleaning blade 21, the cleaning cloth 22 travels to rotate the cloth guide 44 clockwise.

Figure 6A:
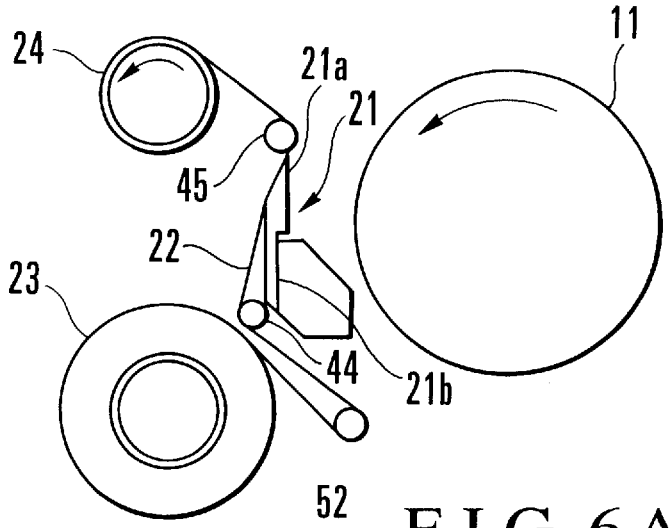
FIGS. 6A to 6C are views for explaining the cleaning operation of the second embodiment of the present invention.
Figure 6B:
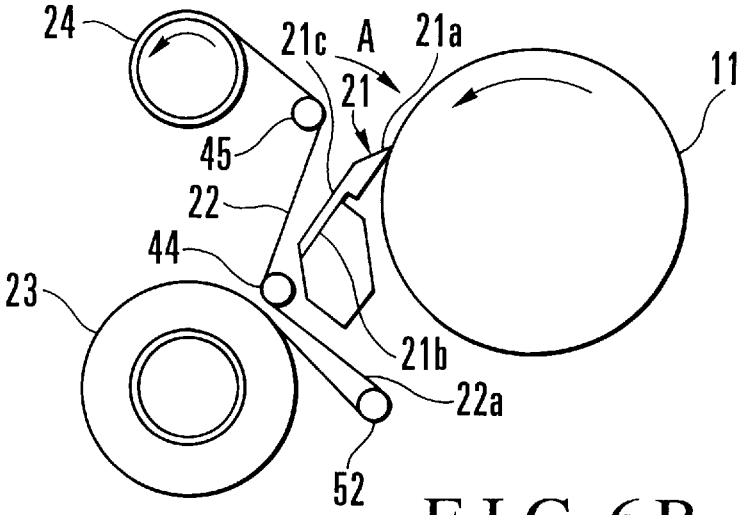

The operation of the cleaning apparatus having the above arrangement will be described with reference to FIGS. 6A to 6C. As shown in FIG. 6A, in a non-cleaning state, a distal end portion 21*a* of the cleaning blade 21 is separate from the circumferential surface of the oscillating roller 11. In this state, when air cylinders 27 are actuated, the cleaning blade 21 pivots in the direction of an arrow A, as shown in FIG. 6B, and its distal end portion 21*a* abuts against the circumferential surface of the oscillating roller 11, so that the cleaning cloth 22 is completely separated from the cleaning blade 21. At this time, the proximal end portion 21*b* of the cleaning blade 21 is located above the cleaning cloth 22 kept taut between the cloth guides 52 and 44.

In this state, the waste ink scraped by the distal end portion 21*a* of the cleaning blade 21 abutting against the circumferential surface of the oscillating roller 11 flows to the proximal end portion 21*b* of the cleaning blade 21 through the inclined rear surface 21*c*. Thereafter, the waste ink drops from the proximal end portion 21*b* to an accepting portion 22*a* of the cleaning cloth 22 kept taut between the cloth guides 52 and 44, and is absorbed and collected by the accepting portion 22*a*.

Subsequently, the cleaning cloth 22 is intermittently fed a plurality of number of times to end collection of the waste ink. In order to wipe off the ink deposited on the rear surface 21*c* of the cleaning blade 21, air cylinders 33 are actuated and rods 33*a* move forward. Hence, as shown in FIG. 6C, the cleaning cloth 22 kept taut between the cloth guides 44 and 45 is pivoted in the direction of an arrow B to come into contact with the entire surface of the rear surface 21*c* of the cleaning blade 21. In this state, an air cylinder 48 is actuated to feed a new portion of the cleaning cloth 22 from the supply roll 23 to the rear surface of the cleaning blade 21, thereby cleaning the rear surface 21*c* of the cleaning blade 21. At this time, the waste ink on the inclined surface of the distal end portion 21*a* of the cleaning blade 21 is also absorbed by the cleaning cloth 22.

Figure 6C:
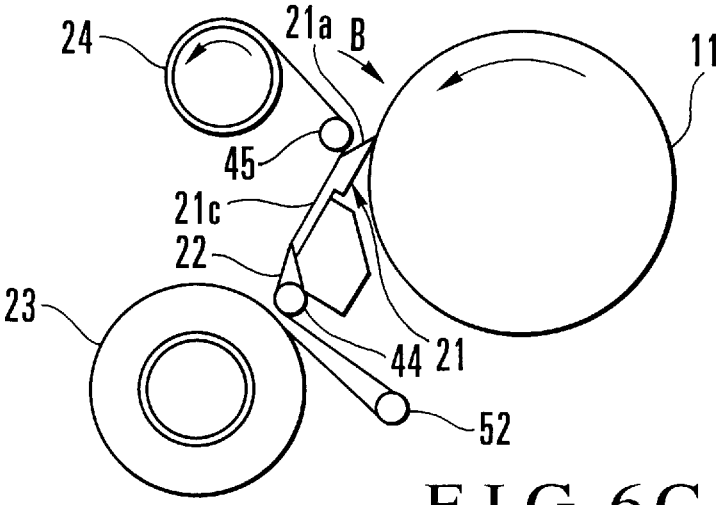

The states of FIGS. 6B and 6C are repeated a predetermined number of times, and the air cylinders 33 and 27 are sequentially restored to return to the initial state shown in FIG. 6A. At this time, the last travel of the cleaning cloth 22 is performed to wipe the waste ink deposited on the inclined surface of the distal end portion 21*a* of the cleaning blade 21, and control waits for the next cleaning operation.

The third embodiment of the present invention will be described. The arrangement of the third embodiment is basically the same as that of the first embodiment shown in FIG. 3, and a detailed description thereof will be omitted. The difference between the third and first embodiments resides in that, in the third embodiment, a cloth guide 45 is arranged higher than the cloth guide 45 (FIG. 3) of the first embodiment, and the sequential operation between the end of the cleaning operation to restoration of the initial state differs from that of the first embodiment.

FIGS. 7A to 7D show the operation of the cleaning unit of a cleaning apparatus according to the third embodiment of the present invention. In the initial state shown in FIG. 7A, air cylinders 27 and 33 are sequentially actuated to shift to the state of FIG. 7C through the state of FIG. 7B, thus cleaning oscillating rollers 11. The sequence so far is identical to that of FIGS. 4A to 4C. When shifting from the state of FIG. 7A to FIG. 7C, this shift may be made by momentarily passing through the state of FIG. 7B. Alternatively, the state of FIG. 7A may be directly shifted to the state of FIG. 7C without passing through the state of FIG. 7B.

Figure 7A:
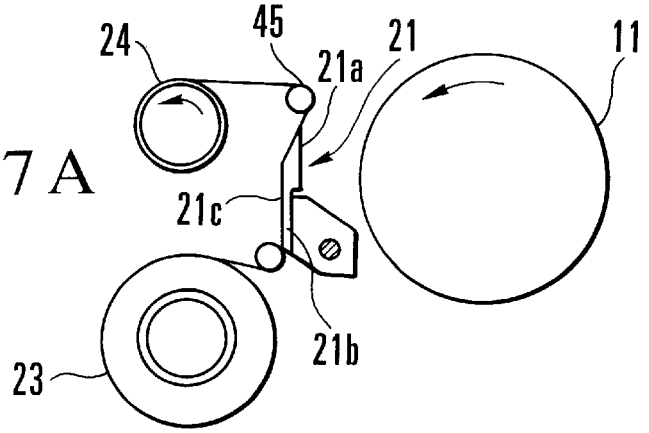
FIGS. 7A to 7C are views for explaining the cleaning operation of the third embodiment of the present invention.
Figure 7B:
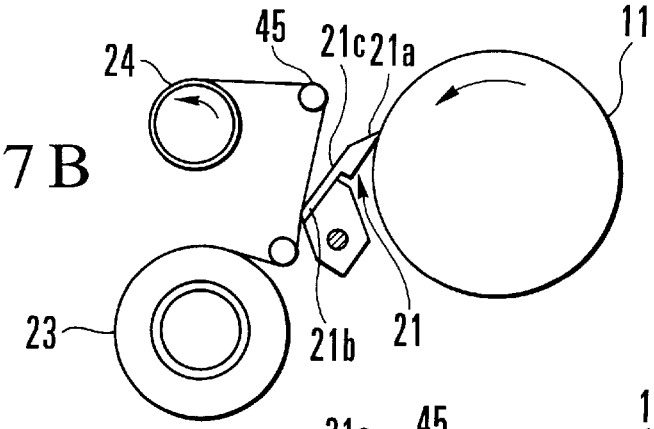
Figure 7C:
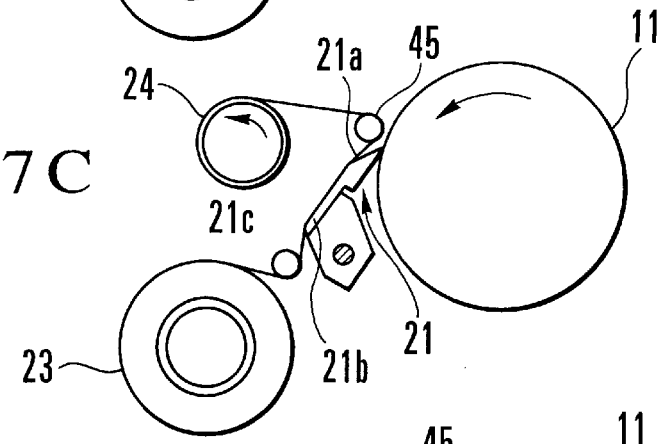
Figure 7D:
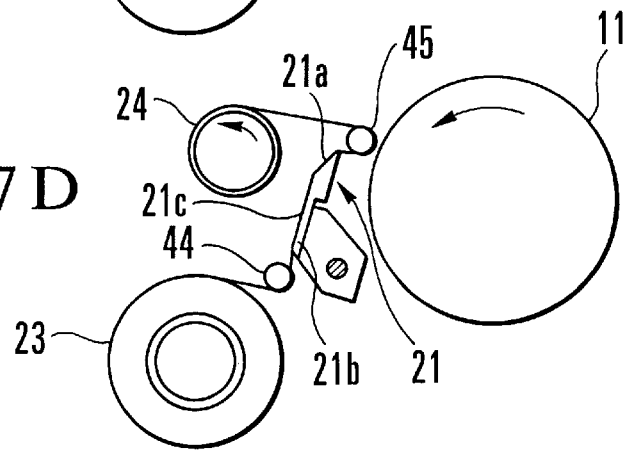

After the cleaning operation of the oscillating roller 11, the air cylinders 33 are not restored but only the air cylinders 27 are restored, so that a distal end portion 21*a* of a cleaning blade 21 separates from the circumferential surface of the oscillating roller 11, as shown in FIG. 7D. At this time, since a cleaning cloth 22 is kept taut between a cloth guide 44 and the cloth guide 45 closely to the circumferential surface of the oscillating roller 11, the cleaning blade 21 abuts against the cleaning cloth 22 at a predetermined angle during restoration to the initial position. Thereafter, the distal end portion 21*a* of the cleaning blade 21 goes under the cloth guide 45 against the tensile force of the cleaning cloth 22. In this state, the cleaning cloth 22 is intermittently fed in order to wipe off the waste ink deposited not only on a rear surface 21*c* and the inclined surface of the distal end portion 21*a* of the cleaning blade 21 but also on the vertex (sharp-cornered portion) of the distal end portion of the cleaning blade 21.

Then, the air cylinders 33 are restored to swing a cleaning unit 20 to a position separate from the oscillating roller 11, so that the cleaning cloth 22 is separated from the circumferential surface of the oscillating roller 11 to be restored to the initial position shown in FIG. 7A. At this position, the cleaning cloth 22 is further taken up to cover its used portion, which has been taken up by a take-up roll 24, with its clean portion, thereby preventing the wiped waste ink from dripping. The vertex of the distal end portion 21*a* of the cleaning blade 21 may be wiped off with the cleaning cloth 22 before restoring to the initial position, after the cleaning blade 21 is restored to the initial position and not while it is being restored there.

In this manner, according to this embodiment, the cloth guide 45 is arranged farther away from the distal end portion 21*a* of the cleaning blade 21 than the cloth guide 45 of the first embodiment. Hence, when only the cleaning blade 21 is separated from the circumferential surface of the oscillating roller 11 from the state of FIG. 7C, the distal end portion 21*a* of the cleaning blade 21 can move under the cloth guide 45 without abutting against it.

In the embodiments described above, the cloth guides 44, 45, and 52 are supported by the cleaning unit 20 and are moved to come close to and separate from the circumferential surface of the oscillating roller 11 upon oscillation of the cleaning unit 20 having the supply roll 23 and take-up roll 24. Alternatively, as shown in FIG. 8, a cleaning cloth travel mechanism consisting of a supply roll 23 and a take-up roll 24 may be fixed, and at least some cloth guide may be moved to come close to and separate from the circumferential surface of an oscillating roller 11.

Figure 8:
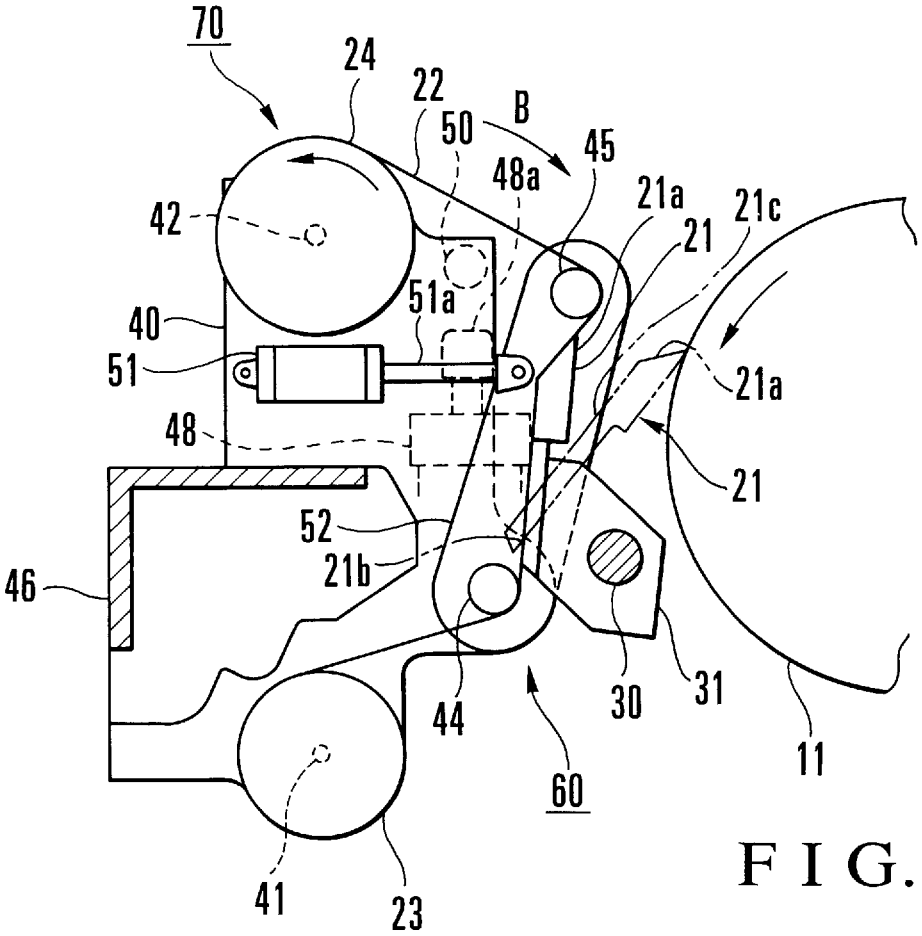
FIG. 8 is a side view showing a modification of the first embodiment of the present invention.

FIG. 8 shows a modification of the first embodiment, in which portions identical to those of the first embodiment are denoted by the same reference numerals as in the first embodiment. An air cylinder 51 has a rod 51*a*, and the distal end portion of the rod 51*a* is connected to an oscillating lever 52 through a pin. The oscillating lever 52 is supported by a cloth guide 44, rotatably supported between unit frames 40 of a cleaning cloth travel mechanism 70, to be oscillatable about it. A cloth guide 45 is rotatably supported by the oscillating end portion of the oscillating lever 52. A guide shift mechanism 60 is constituted by the cloth guides 44 and 45, the air cylinder 51, and the oscillating lever 52. The guide shift mechanism 60 shifts the guide position of a cleaning cloth 22, driven by the cleaning cloth travel mechanism 70, between a position where the cleaning cloth 22 comes close to the circumferential surface of an oscillating roller 11 and a position where it is separate therefrom.

In this arrangement, when shifting from the state of FIG. 4B to the state of FIG. 4C, the air cylinder 51 is actuated to move the rod 51*a* forward, instead of oscillating the cleaning unit 20 (FIG. 3), so that the oscillating lever 52 of the guide shift mechanism 60 is shifted to the position where it comes close to the circumferential surface of the oscillating roller 11. Hence, the cleaning cloth 22 comes into contact with a rear surface 21*c* of a cleaning blade 21, in the same manner as in FIG. 4C, to wipe off the waste ink on the cleaning blade 21. In the state of FIG. 4C, the air cylinder 51 is restored, so that the oscillating lever 52 is shifted to a position separate from the circumferential surface of the oscillating roller 11, as shown in FIG. 4B. The cleaning blade 21 is then immediately restored to the initial position, so that the state of FIG. 4B is restored.

In the embodiments described above, during cleaning, the cleaning cloth 22 is repeatedly brought into contact with and separated from the rear surface 21*c* of the cleaning cloth 22. However, during cleaning, the cleaning cloth 22 which is traveling intermittently may be brought into continuous contact with the rear surface 21*c* of the cleaning blade 21.

In the embodiments described above, the cleaning unit 20 having the take-up roll 24 and the cloth guide 45 is pivoted in the direction of the arrow B about the supply roll 23 as the pivot center. However, the cleaning unit 20 may be pivoted about the cloth guide 44 as the pivot center.

As has been described above, according to the present invention, the waste ink can be collected while the ink blade is in contact with the ink roller. Therefore, when compared to a conventional case wherein the ink blade is intermittently separated from the ink roller, the cleaning time is shortened. Since the cleaning web does not come into contact with the ink roller, the cleaning web will not be caught by the ink roller to prevent a cleaning trouble. Since the cleaning web is not torn apart by the ink roller, no expensive special cleaning cloth having high durability need be employed, and a generally used inexpensive cleaning cloth can be employed.

What is claimed is:

1. A cleaning apparatus for a rotary printing press, comprising:

a cleaning blade having a distal end portion which abuts against a circumferential surface of an ink roller during a cleaning operation to scrape a waste ink, and a guide surface continuous to said distal end portion to guide the scraped waste ink downward;

a cleaning web which travels during the cleaning operation done by said cleaning blade to collect the waste ink scraped by said cleaning blade; and an ink collection mechanism for bringing said cleaning web into contact with said guide surface of said cleaning blade, when said distal end portion of said cleaning blade is in contact with said circumferential surface of said ink roller, to collect the waste ink on said cleaning blade, said ink collection mechanism including a cleaning unit which supports said cleaning web and means for reciprocally moving said cleaning unit between a first position where said cleaning unit comes close to said circumferential surface of said ink roller and a second position where said cleaning unit is separate from said circumferential surface of said ink roller;

said means for reciprocally moving including first drive means for driving said cleaning unit from the second position to said first position to bring said cleaning web into contact with said guide surface of said cleaning blade during the cleaning operation for said ink roller, said cleaning web not coming into contact with the peripheral surface of the ink roller when the cleaning unit is at the first position where it is close to the peripheral surface of the ink roller; and, said means for reciprocally moving further including second drive means for driving said distal end portion of said cleaning blade in directions to come into contact with and separate from said circumferential surface of said ink roller.

2. An apparatus according to claim 1, further comprising a take-up roll for taking up said cleaning web, wherein the waste ink on said cleaning blade is collected by said ink collection mechanism, and thereafter a clean portion of said cleaning web which is not soiled with the waste ink is taken up by said take-up roll to cover a surface of said take-up roll.

3. An apparatus according to claim 1, further comprising a cleaning web travel mechanism having a supply roll for supplying said cleaning web and a take-up roll for taking up said cleaning web supplied from said supply roll, said supply roll and said take-up roll being rotatably supported by said cleaning unit, wherein said cleaning web travel mechanism includes means for causing said cleaning web to travel intermittently from said supply roll to said take-up roll during the cleaning operation for said ink roller.

4. An apparatus according to claim 3, wherein said means for causing said cleaning web to travel has a guide member supported by said cleaning unit to guide said cleaning web, which travels from said supply roll to said take-up roll, to a guide surface side of said cleaning blade, and when said cleaning unit is located at the first position, said cleaning web guided by said guide member comes into contact with said guide surface of said cleaning blade which is cleaning said ink roller, said cleaning web collecting the waste ink on said guide surface of said cleaning blade.

5. An apparatus according to claim 4, wherein said cleaning blade has a proximal end portion which is continuous from said distal end portion through said guide surface, and when said cleaning unit is located at the second position, said cleaning web guided by said guide member comes into contact with said proximal end portion of said cleaning blade to collect the waste ink.

6. An apparatus according to claim 5, wherein when the cleaning operation for said ink roller is ended, said cleaning unit includes means for moving said cleaning unit from the first position to the second position, and almost simultaneously said cleaning blade separates from said ink roller and is restored to an initial position to be in contact with said cleaning web, and when said cleaning blade is located at the initial position, the waste ink at least deposited on said distal end portion of said cleaning blade is wiped off with said traveling cleaning web.

7. An apparatus according to claim 5, wherein when the cleaning operation for said ink roller is ended, said distal end portion of said cleaning blade abuts against said cleaning web at a predetermined angle during restoration of said cleaning blade to the initial position by means for separating said cleaning blade from said ink roller while said cleaning unit is located at the first position, and when said distal end portion of said cleaning blade is in contact with said cleaning web, the waste ink deposited on at least a vertex portion of said distal end portion of said cleaning blade is wiped off by said traveling cleaning web.

8. An apparatus according to claim 3, wherein said means for causing said cleaning web to travel has a guide member supported by said cleaning unit to guide said cleaning web, which travels from said supply roll to said take-up roll, below said proximal end portion of said cleaning blade, and thereafter to a guide surface side of said cleaning blade, and when said cleaning unit is located at the first position, said cleaning web guided by said guide member comes into contact with said guide surface of said cleaning blade, said cleaning web collecting the waste ink from said guide surface of said cleaning blade.

9. An apparatus according to claim 8, wherein said cleaning blade has a proximal end portion which is continuous from said distal end portion through said guide surface, and when said cleaning unit is located at the second position, said cleaning web guided by said guide member collects the waste ink dropping from said proximal end portion of said cleaning blade, and is taken up by said take-up roll without coming into contact with said cleaning blade.

10. An apparatus according to claim 9, wherein when the cleaning operation for said ink roller is ended, said cleaning unit includes means for oscillating said cleaning unit from the second position to the first position, and thereafter said cleaning blade separates from said ink roller and is restored to an initial position to be in contact with said cleaning web, and when said cleaning blade is located at the initial position, the waste ink deposited on at least said distal end portion of said cleaning blade is wiped off with said traveling cleaning web.

11. An apparatus according to claim 1, wherein said cleaning blade and said cleaning unit perform a sequence operation by driving and restoring said first and second drive means in a predetermined order.

12. An apparatus according to claim 1, wherein said cleaning blade inclines upward such that said distal end portion thereof comes into contact with said circumferential surface of said ink roller which rotates downward, and said guide surface of said cleaning blade comprises a surface which does not oppose said circumferential surface of said ink roller.

13. A cleaning apparatus for a rotary printing press, comprises:

a cleaning blade having a distal end portion which abuts against a circumferential surface of an ink roller during a cleaning operation to scrape a waste ink, and a guide surface continuous to said distal end portion to guide the scraped waste ink downward;

a cleaning web which travels during the cleaning operation done by said cleaning blade to collect the waste ink scraped by said cleaning blade; and, an ink collection mechanism for bringing said cleaning web into contact with said guide surface of said cleaning blade, when said distal end portion of said cleaning blade is in contact with said circumferential surface of said ink roller, to collect the waste ink on said cleaning blade, said ink collection mechanism including:

a cleaning web travel mechanism for causing said cleaning web to travel;

a guide unit which reciprocally moves between a first position where said guide unit comes close to said circumferential surface of said ink roller and a second position where said guide unit is separate from said circumferential surface of said ink roller, said guide unit serving to guide said cleaning web which travels at the first and second positions;

first drive means for driving said guide unit from the second position to the first position to bring said cleaning web into contact with said guide surface of said cleaning blade during the cleaning operation for said ink roller, said cleaning web not coming into contact with the peripheral surface of the ink roller when the cleaning unit is at the first position where it is close to the peripheral surface of the ink roller; and, second drive means for driving said distal end portion of said cleaning blade in directions to come into contact with and separate from said circumferential surface of said ink roller.

* * * * *

UNITED STATES PATENT AND TRADEMARK OFFICE

CERTIFICATE OF CORRECTION

PATENT NO. : 5,868,073

DATED : February 9, 1999

INVENTOR(S) : Ebina

It is certified that error appears in the above-identified patent and that said Letters Patent is hereby corrected as shown below:

In [54], delete "Cleaning Apparatus for Web Offset Printing Press" and insert -- Cleaning Apparatus for Rotary Printing Press -- .

In column 1, line 1, delete "Cleaning Apparatus for Web Offset Printing Press" and insert -- Cleaning Apparatus for Rotary Printing Press -- .

In column 1, line 63, delete "cleaning apparatus for a web offset printing press" and insert -- cleaning apparatus for a rotary printing press -- .

Signed and Sealed this

Twenty-fourth Day of October, 2000

*Attest:*

Q. TODD DICKINSON

*Attesting Officer*

*Director of Patents and Trademarks*